US007547249B2

(12) United States Patent
Seliger et al.

(10) Patent No.: US 7,547,249 B2
(45) Date of Patent: Jun. 16, 2009

(54) EXHAUST FAN ASSEMBLY HAVING H-OUT NOZZLE

(75) Inventors: Michael G. Seliger, Marathon, WI (US); John W. Enzenroth, Weston, WI (US)

(73) Assignee: Greenheck Fan Corporation, Schofield, WI (US)

( * ) Notice: Subject to any disclaimer, the term of this patent is extended or adjusted under 35 U.S.C. 154(b) by 0 days.

(21) Appl. No.: 11/181,133

(22) Filed: Jul. 14, 2005

(65) Prior Publication Data

US 2006/0014484 A1 Jan. 19, 2006

Related U.S. Application Data

(60) Provisional application No. 60/588,074, filed on Jul. 15, 2004, provisional application No. 60/625,220, filed on Nov. 5, 2004.

(51) Int. Cl.
*F23L 17/02* (2006.01)
*F23L 17/00* (2006.01)

(52) U.S. Cl. ..... 454/16; 454/17; 454/39; 110/162

(58) Field of Classification Search ..... 454/3, 454/4, 15, 16, 17, 33, 36, 39, 40; 415/212.1; 417/155, 198; 110/162; 239/592
See application file for complete search history.

(56) References Cited

U.S. PATENT DOCUMENTS

| | | | | |
|---|---|---|---|---|
| 37,270 | A * | 1/1863 | Betts | 454/39 |
| 297,972 | A | 5/1884 | Day | |
| 352,597 | A | 11/1886 | Wohlfert | |
| 603,881 | A | 5/1898 | Kuphal | |
| 648,801 | A | 5/1900 | Schubert | |
| 736,748 | A | 8/1903 | Le Beau | |
| 852,480 | A | 5/1907 | Whitehead | |

(Continued)

FOREIGN PATENT DOCUMENTS

| | | |
|---|---|---|
| FR | 1173612 | 12/1959 |

(Continued)

OTHER PUBLICATIONS

Attached Appendix A (Figure 2 in US 2003/0114098 A1 with examiner's annnotations).*

(Continued)

*Primary Examiner*—Steven B McAllister
*Assistant Examiner*—Patrick F. O'Reilly, III
(74) *Attorney, Agent, or Firm*—Quarles & Brady LLP

(57) ABSTRACT

An exhaust system for expelling air from a building includes an outlet nozzle that improves entrainment of ambient air with the building exhaust air. The improved air entrainment results in increased exhaust air dilution and plume height to better disperse the exhaust air away from the building. The nozzle has an H-shaped outlet configuration with two lateral outlet sections joined by a central transverse outlet section. The nozzle has a pair of outer lateral walls, a pair of outer transverse walls, and a pair of sloped inner lateral walls that angle outwards from near an inlet end of the nozzle towards corresponding outer lateral walls. The nozzle can be part of the exhaust system at the outlet side of the exhaust fan within a windband that aids in entraining ambient air with the exhaust air exiting the nozzle.

16 Claims, 4 Drawing Sheets

U.S. PATENT DOCUMENTS

| | | | | | |
|---|---|---|---|---|---|
| 1,053,507 | A | * | 2/1913 | De Kernia | 454/359 |
| 1,126,348 | A | | 1/1915 | Basman | |
| 1,296,040 | A | | 3/1919 | Bontya | |
| 1,346,633 | A | | 7/1920 | Cloud | |
| 1,394,735 | A | | 10/1921 | Jordan | |
| 1,729,152 | A | * | 8/1929 | Kiesel, Jr. | 417/155 |
| 1,891,860 | A | | 12/1932 | Woolf | |
| 1,986,176 | A | | 1/1935 | Zwerling | |
| 2,188,564 | A | | 1/1940 | Berg | |
| 2,265,112 | A | | 12/1941 | Davies | |
| 2,269,050 | A | * | 1/1942 | Zimmerman | 454/39 |
| 2,363,733 | A | | 11/1944 | Karol | |
| 2,478,761 | A | | 8/1949 | Houseman | |
| 2,514,247 | A | | 7/1950 | Leardi et al. | |
| 2,605,693 | A | | 8/1952 | Hansen | |
| 2,714,847 | A | | 8/1955 | Svebel | |
| 2,973,825 | A | * | 3/1961 | Bertin | 181/220 |
| 3,045,579 | A | | 7/1962 | Jenn et al. | |
| 3,069,071 | A | | 12/1962 | Carlson | |
| 3,087,409 | A | | 4/1963 | Carr | |
| 3,115,820 | A | | 12/1963 | Adelt | |
| 3,209,670 | A | | 10/1965 | Twickler | |
| 3,283,694 | A | | 11/1966 | Dean, Jr. | |
| 3,285,567 | A | | 11/1966 | Richardson | |
| 3,288,377 | A | * | 11/1966 | Van de Roer | 239/433 |
| 3,347,147 | A | | 10/1967 | Howard | |
| 3,385,197 | A | | 5/1968 | Greber | |
| 3,537,411 | A | | 11/1970 | Roy | |
| 3,719,032 | A | | 3/1973 | Cash | |
| 3,727,566 | A | | 4/1973 | Roy | |
| 3,730,073 | A | | 5/1973 | Potter | |
| 3,797,373 | A | | 3/1974 | Larson | |
| 3,817,162 | A | | 6/1974 | Guelph | |
| 4,095,514 | A | | 6/1978 | Roy et al. | |
| 4,184,417 | A | | 1/1980 | Chancellor | |
| 4,204,463 | A | | 5/1980 | Carty | |
| 4,344,370 | A | | 8/1982 | Smith et al. | |
| 4,525,223 | A | * | 6/1985 | Tsuya et al. | 438/490 |
| 4,655,121 | A | | 4/1987 | Ludwig | |
| 4,682,206 | A | * | 7/1987 | Tsuya et al. | 257/64 |
| 4,806,076 | A | | 2/1989 | Andrews | |
| 4,915,141 | A | * | 4/1990 | Nitta et al. | 139/435.5 |
| 4,993,314 | A | | 2/1991 | Braden et al. | |
| 5,326,317 | A | | 7/1994 | Ishizu et al. | |
| 5,439,349 | A | | 8/1995 | Kupferberg | |
| 6,053,162 | A | * | 4/2000 | Godfree et al. | 126/85 B |
| 6,112,850 | A | | 9/2000 | Secrest et al. | |
| 6,431,974 | B1 | | 8/2002 | Tetley et al. | |
| 6,676,503 | B2 | | 1/2004 | Hill et al. | |
| 7,018,287 | B2 | * | 3/2006 | Kupferberg et al. | 454/16 |
| 2003/0114098 | A1 | * | 6/2003 | Hill et al. | 454/16 |
| 2004/0146821 | A1 | * | 7/2004 | Joshi | 431/8 |

FOREIGN PATENT DOCUMENTS

| | | |
|---|---|---|
| GB | 507787 | 6/1939 |
| GB | 610153 | 10/1948 |

OTHER PUBLICATIONS

Attached Appendix B (Figure 5 in US 2003/0114098 A1 with examiner's annotations).*

* cited by examiner

EXHAUST FAN ASSEMBLY HAVING H-OUT NOZZLE

CROSS-REFERENCE TO RELATED APPLICATIONS

This application claims priority to U.S. Provisional Application No. 60/588,074 filed on Jul. 15, 2004, and U.S. Provisional Application No. 60/625,220 filed Nov. 5, 2004, the disclosure of each of which is hereby incorporated by reference as if set forth in its entirety herein.

BACKGROUND OF THE INVENTION

The present invention relates generally to exhaust nozzles, and more particularly to nozzles for use with exhaust systems that evacuate fumes or otherwise draw undesirable air from within a building or enclosure.

There are many different types of exhaust systems for buildings and enclosed spaces. In areas such as laboratories and kitchens, fumes are often produced that have an unpleasant odor or are otherwise undesirable. It is common to outfit such environments with exhaust systems that draw the fumes from the building and dispel them through an exhaust port that is typically located on an external wall or roof of the building.

Furthermore, it is often desirable to expel the air a distance from the exterior of the building to avoid introducing it into the environment surrounding the building. Many conventional exhaust systems employ tall exhaust towers or stacks so that the air exits the building well above ground level. However, these exhaust stacks are expensive to construct and maintain and are generally considered unsightly.

Exhaust systems have been developed that use high velocity fans to force the air away from the building and surrounding area without the need for towers or stacks. Also, systems have been developed that combine the forced air exhaust systems with systems that mix the undesirable air with fresh air to dilute the concentration of the undesirable air before it is exhausted from the building at a high velocity. Such exhaust systems are commercially available from Greenheck Fan Corporation of Wisconsin under the Vektor model name. By diluting the undesirable air before release into the surrounding environment, these systems reduce the amount of separation desired between the release point and the surrounding environment. The air is thus forced to a desirable distance from the building and surrounding environment by fan power without the need for unsightly towers or stacks and the associated costs.

While these "stack-less" exhaust systems are desirable, they typically have associated maintenance costs and may not be suitable for a given application without significant adaptation for the particular performance specifications of the given application. For example, in some circumstances, a particular fan arrangement, that is, motor size, blade configuration, and/or nozzle configuration, may not achieve and sustain flow characteristics to achieve the plume height and flow volume necessary to exhaust the air a sufficient distance from the building and surrounding environment.

Drive motor sizing and fan blade size, quantity, and configuration affect the performance and efficiency of the exhaust system. The configuration of the outlet nozzle is also very important, as is the configuration of the windband that is placed about the nozzle to help entrain ambient air with the exhaust air exiting the nozzle. While many conventional windbands are open-ended annular structures that vary primarily by entry and exit diameter, the size and shape of the outlet nozzle can vary significantly and thus is one of the most important elements to consider when designing the exhaust system.

One example of an existing exhaust nozzle is described in U.S. Pat. No. 6,676,503. This patent discloses one exhaust nozzle configuration having an outlet defined by curved, convoluted outer walls that taper inwardly from an inlet side of the nozzle toward the outlet. The patent discloses outlets taking generally rounded X-, Y-, and I-shaped configurations, all of which are defined by inwardly tapering outer walls. A drawback with the disclosed nozzle is that the air exiting the nozzle moves in a generally inward direction toward the vertical centerline of the windband above the nozzle due to the inward taper of the nozzle walls. This does not optimally entrain ambient air with the building exhaust air, possibly because the periphery of the exiting air is not sufficiently turbulent or because the area of the flow path is not large enough. In any event, the result is less dilution of the undesirable air and a lower plume height due to lesser air mass passing through the windband.

As such, it would be desirable for an exhaust system to have an improved nozzle configuration that betters air expulsion.

BRIEF SUMMARY OF THE INVENTION

The present invention overcomes the aforementioned drawbacks by providing a building exhaust system nozzle that improves entrainment of ambient air with the building exhaust air. The improved air entrainment results in increased exhaust air dilution and plume height to better disperse the exhaust air away from the building surroundings.

In accordance with one aspect of the invention, an exhaust assembly nozzle is disclosed that includes a pair of outer lateral walls and a pair of outer transverse walls extending from an inlet and forming an airflow path from the inlet to an outlet. The exhaust assembly nozzle also includes a pair of sloped inner lateral walls that angle outwards from at or near the inlet towards corresponding outer lateral walls to form a pair of laterally extending outlets at the outlet. The sloped inner lateral walls direct air exiting the outlets in a laterally outward direction.

In accordance with another aspect of the invention, an exhaust nozzle for a ventilation system is disclosed that includes a base frame member arranged at an inlet, a pair of outer lateral walls extending from opposing sides of the base frame member, and a pair of outer transverse walls extending from opposing sides of the base frame member and disposed between the pair of opposing outer lateral walls. The exhaust nozzle also includes a first set of inner lateral walls and a second set of inner lateral walls extending from a vertex at the inlet toward the pair of outer lateral walls and, with the pair of outer lateral walls and the pair of outer transverse walls, forming a pair of laterally extending outlets at an outlet of the nozzle. The exhaust nozzle further includes a pair of spaced transverse walls separating the first set of inner lateral walls and the second set of inner lateral walls to form a transverse outlet at the outlet of the nozzle that joins the pair of laterally extending outlets.

In accordance with yet another aspect of the invention, a ventilation system nozzle is disclosed that includes a pair of outer lateral walls and a pair of outer transverse walls arranged between the pair of outer lateral walls to form a generally rectangular nozzle inlet. The ventilation system nozzle also includes a first pair of inner lateral walls and a second pair of inner lateral walls sloped from a respective common axis toward the outer lateral walls to form a pair of laterally extending outlets. The ventilation system further includes a pair of spaced transverse walls disposed between the first pair of inner lateral walls and the second pair of inner lateral walls to form a transverse outlet joining the pair of laterally extending outlets to form a generally H-shaped nozzle outlet.

An exhaust system with the nozzle of the present invention can effect improved entrainment of ambient air with building exhaust air by increasing mixing of the two air masses. This increases the dilution of the building exhaust air leaving the exhaust system. It also increases the flow volume such that the height of the plume expelled from the exhaust system is increased. Better dispersion of the exhaust air is thus achieved. Empirical study of a particular nozzle configuration according to the present invention confirms that air entrainment increased at least 10-20% over conventional nozzle configurations, for example, annular converging nozzles.

Various other features and advantages of the present invention will be made apparent from the following detailed description and the drawings.

BRIEF DESCRIPTION OF THE DRAWINGS

Reference is hereby made to the following drawings in which like reference numerals correspond to like elements throughout, and in which.

DETAILED DESCRIPTION OF THE PREFERRED EMBODIMENT(S)

Figure 1:
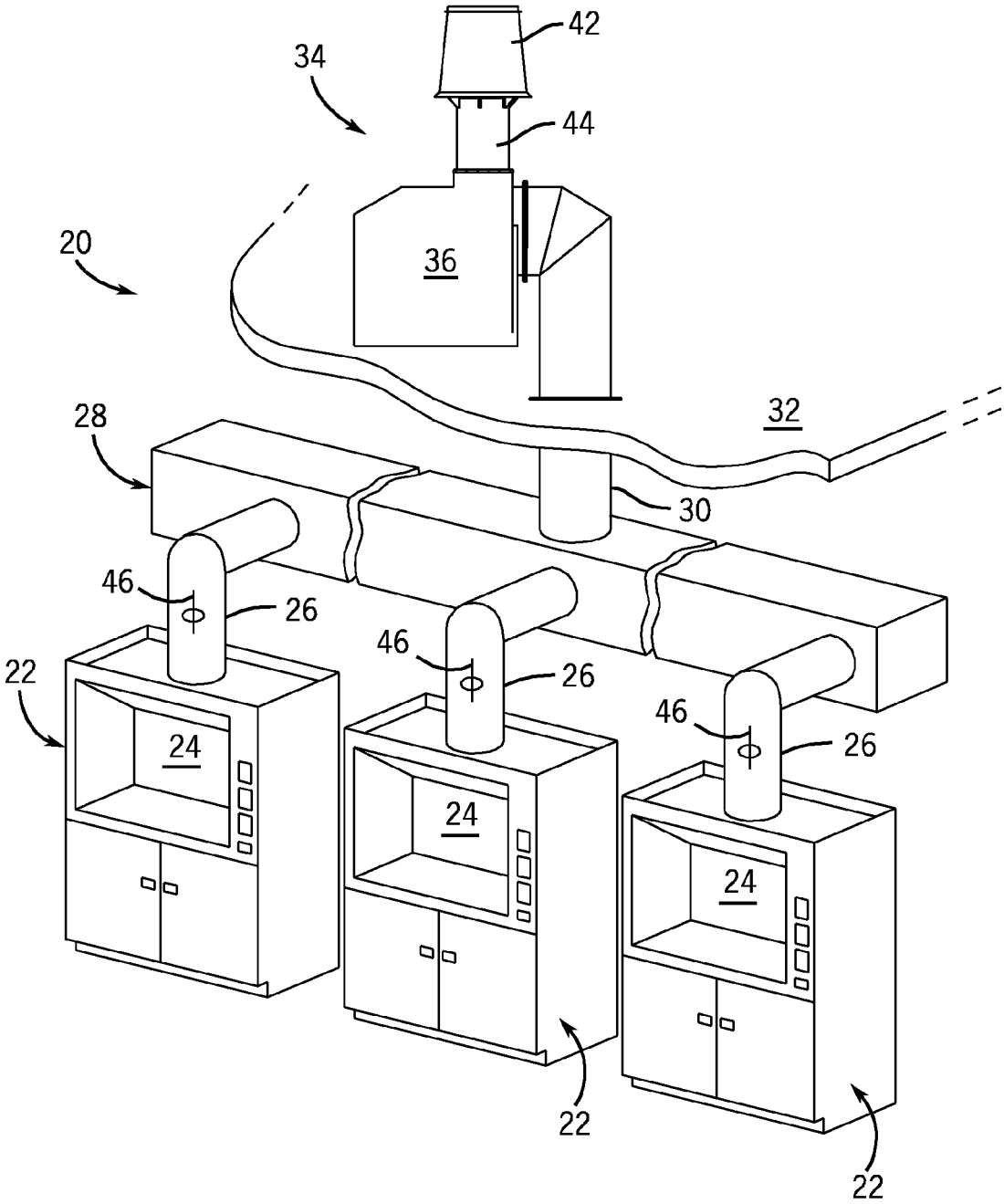
FIG. 1 is a perspective view of a building ventilation system including an exhaust nozzle in accordance with the present invention.

Referring to FIG. 1, a building ventilation system 20 is shown that includes a plurality of fume hoods 22 of the type often installed in commercial kitchens, laboratories, manufacturing facilities, or other similar locations where fumes or other undesirable air may be generated. In the illustrated example, each fume hood 22 includes a chamber 24 that is open at a front of the hood 22 for receiving surrounding air. While the chambers 24 are shown as an enclosed space, it is contemplated that the present invention may be used with any of a variety of ventilation systems 20, such as traditional ceiling-mounted fume hoods or the like. A conduit 26 extends from each hood 22 and forms a passage from each hood 22 to a manifold 28. The manifold 28 is connected to a riser 30 that extends upwards to a roof 32 or other exterior surface of the building. The riser 30 is, in turn, connected to an exhaust assembly 34 that is mounted on top of the roof 32 and extends upwards away from the roof 32 to expel fumes, air, or other gasses away from the building. In accordance with one embodiment, the exhaust assembly 34 may include a plenum 36 disposed at the base of the exhaust assembly 34 that receives exhaust from the riser 30 and mixes the exhaust with fresh air.

Figure 2:
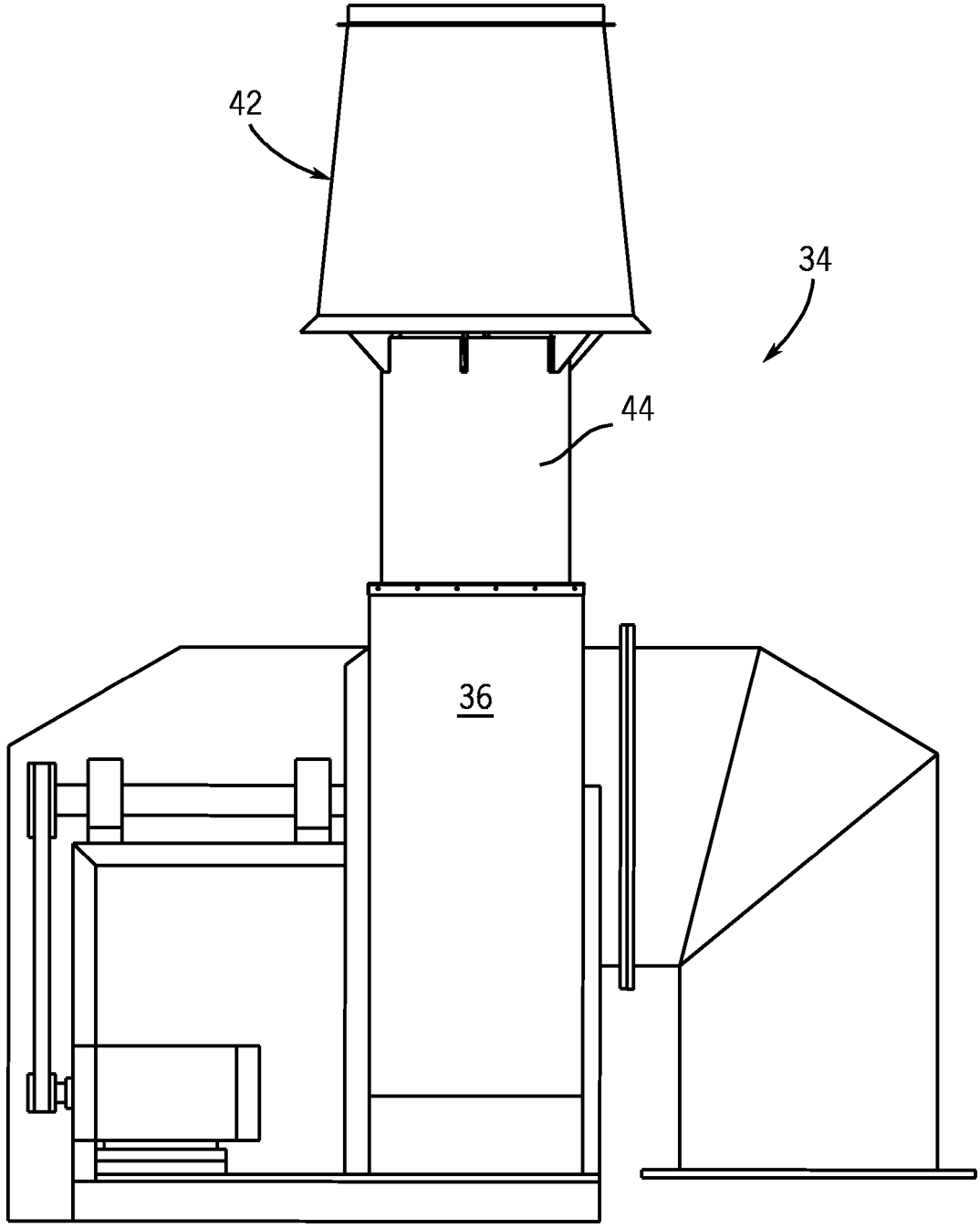
FIG. 2 is a side elevation view of an exhaust assembly of the ventilation system of FIG. 1.

Referring now to FIG. 2, a fan assembly (not shown) of the exhaust assembly 34 is connected to, and extends upwards from, the plenum 36. The fan assembly includes a fan wheel that aids in drawing exhaust upward through the plenum 36 and blowing it out through a windband 42. As will be described with respect to FIGS. 3-6, the windband 42 is mounted just above a nozzle 44, preferably with the outlet of the nozzle 44 being about flush with the entry side of the windband 42, which narrows in the downstream direction, as shown in FIG. 2. The nozzle 44 of the present invention is configured, as discussed in detail below, to deliver the expelled air so as to better entrain ambient air when compared to conventional nozzles.

Referring again to FIGS. 1 and 2, during operation, the exhaust assembly 34 draws airflow that travels from each fume hood 22, through conduits 26, manifold 28, and riser 30 and then is expelled under high velocity upward from the windband 42. In accordance with one embodiment, the exhaust air is mixed with fresh air from plenum 36 before being expelled upward at high velocity from the windband 42.

The control of the exhaust assembly 34 typically includes both mechanical and electronic control elements. A conventional damper 46 may be disposed in the conduit 26 at a location slightly above each hood 22. The damper 46 may be manually or automatically actuated between a fully open orientation (as illustrated) and a fully closed orientation to control the amount of air evacuated from the chamber 24.

Figure 3:
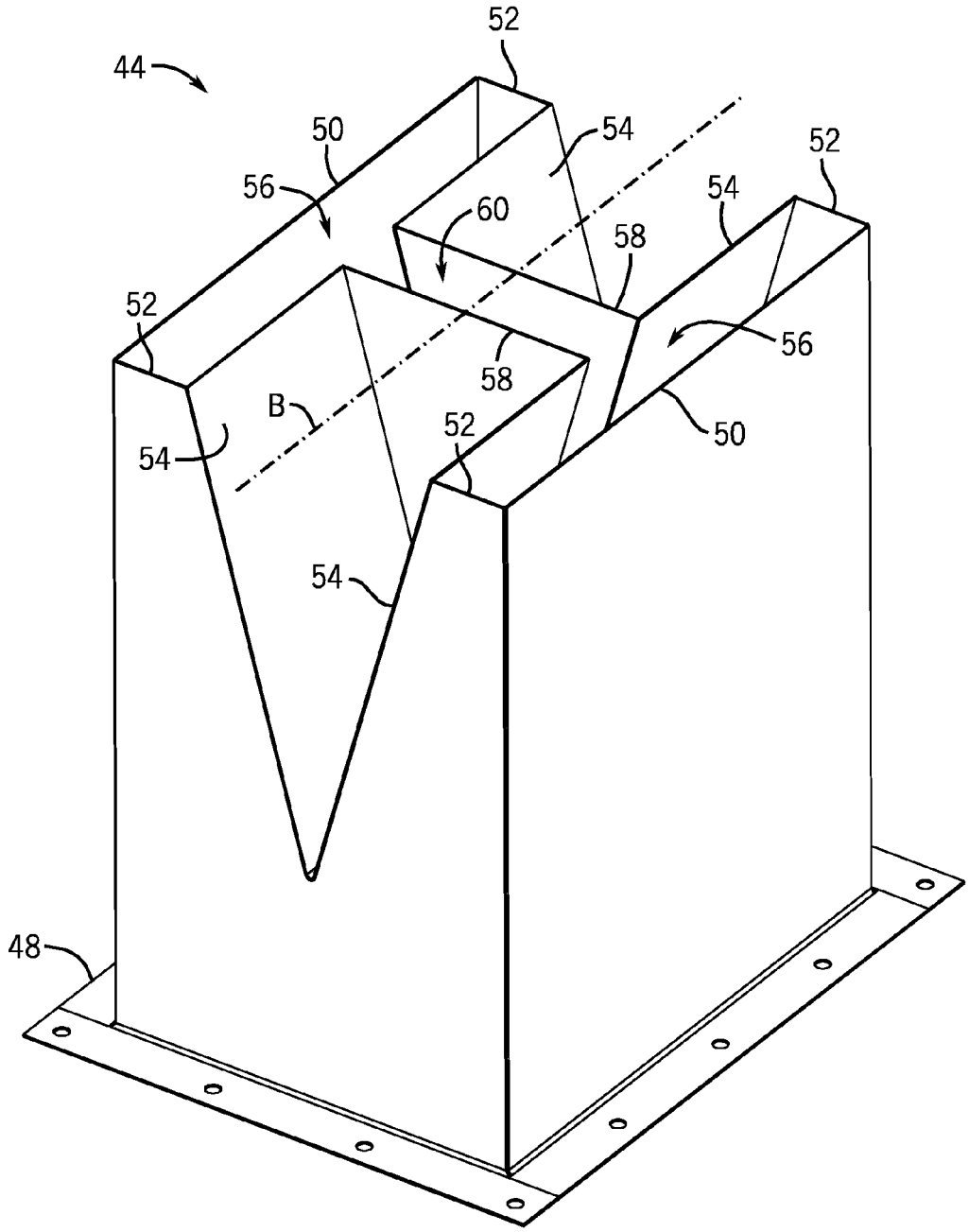
FIG. 3 is a top, front perspective view of an exhaust nozzle of the exhaust assembly of FIG. 2.
Figure 4:
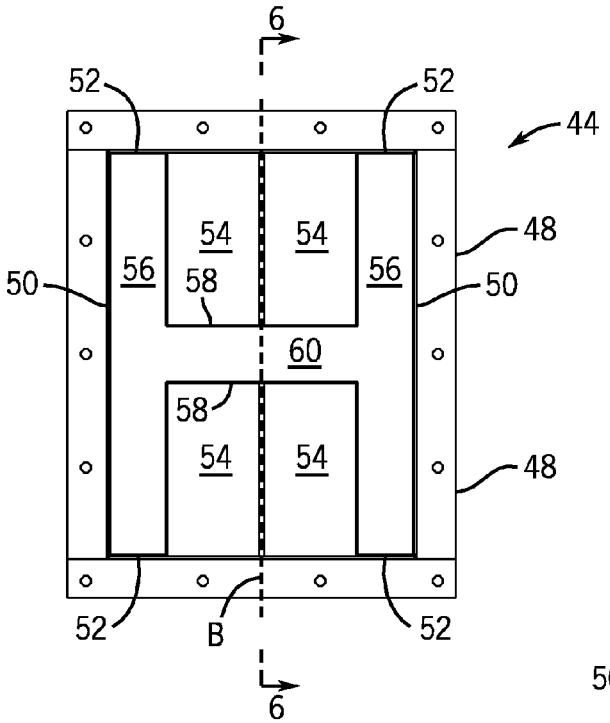
FIG. 4 is top plan view thereof.

Referring now to FIG. 3-6, the nozzle 44 is shown in detail. As illustrated, the nozzle 44 is substantially "H-shaped" when viewed from a top view, such as shown in FIG. 4. The nozzle 44 includes a rectangular base frame member 48 having a rectangular open lower end forming an airflow inlet 49. At each of the other sides of the base, a pair of opposing outer lateral walls 50 extends from corresponding opposing sides of the base 48. A pair of opposing outer transverse walls 52 extends from near the base 48 to join the outer lateral walls 50 at generally perpendicular corners and form a generally rectangular outer wall. A pair of sloped inner lateral walls 54 extend outwardly from the base 48 toward the outer lateral walls 50 to create a pair of laterally extending outlets 56 therebetween. More particularly, the pair of outer lateral walls 50 and the pair of outer transverse walls 52 together form outer walls of the laterally extending outlets 56 and the inner lateral walls 54 form the inner walls of the laterally extending outlets 56. The pair of inner lateral walls 54 is bisected and separated by a pair of spaced transverse walls 58 that extend from the base 48 and are generally parallel to a vertical axis, denoted A, to define a transverse outlet 60 extending between the laterally extending outlets 56. As such, the pair of inner lateral walls 54 is divided by the spaced transverse walls 58 to create a first set of inner lateral walls and a second set of inner lateral walls.

When nozzle 44 is mounted at an output of a building ventilation system, such as described with respect to FIGS. 1 and 2, the outer lateral walls 50, outer transverse walls 52, and spaced transverse walls 58 extend vertically and generally parallel to the vertical axis A. However, in accordance with one embodiment, it is contemplated that the outer lateral walls 50, outer transverse walls 52, and spaced transverse walls 58 may be arranged to deviate from a generally parallel alignment. For example, it is contemplated that the outer lateral walls 50, outer transverse walls 52, and spaced transverse walls 58 may include a slope toward or away from the central vertical axis A.

Figure 5:
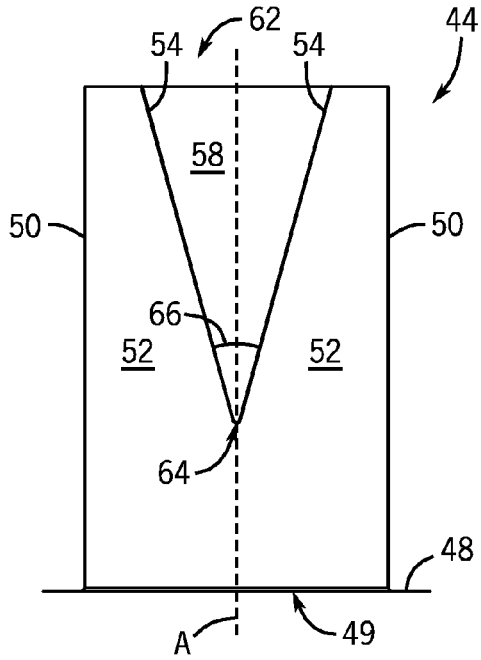
FIG. 5 is a side elevational view thereof.
Figure 6:
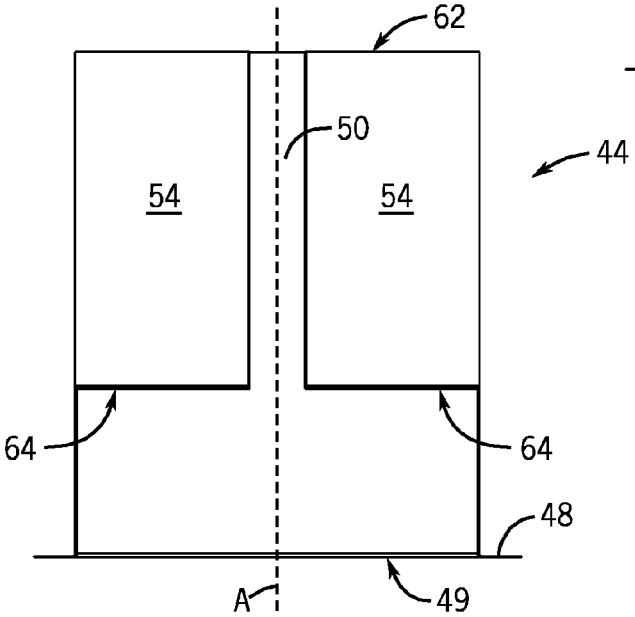
FIG. 6 is a cross-sectional view of the exhaust nozzle taken along line 6-6 of FIG. 4.

As best shown in FIG. 5, the pair of sloped inner lateral walls 54 extends outwardly from the base 48 and away from one another. More particularly, the sloped inner lateral walls 54 extend vertically from the base 48 and angle outwards away from the vertical axis A. In particular, as shown with respect to FIGS. 5 and 6, the inner lateral walls 54 extend from a common vertex 64 located toward the base end of the nozzle, for example, at, near or spaced less than half way up from the base 48. Accordingly, the sloped inner lateral walls 54 slope towards the corresponding outer lateral walls 50. In this regard, the inner lateral walls 54 reduce the size of laterally extending outlets 56 with respect to the inlet defined near the base 48 by the outer lateral walls 50 and the transverse wall 52.

As shown in FIG. 5, the pair of sloped inner lateral walls 54 form an angle 66 therebetween. However, while the illustrated embodiment shows the angle 66 as being an acute angle, it is contemplated that some nozzle arrangements may benefit from the sloped inner lateral walls 54 having a reduced slope to create a right or even obtuse angle (not shown) therebetween. Additionally, while in the illustrated embodiment the sloped inner lateral walls 54 on either side of the spaced transverse walls 58 extend outwardly with a similar slope or pitch, it is contemplated that the sloped inner lateral walls 54 on either side of the spaced transverse walls 58 may extend outwardly at different slopes or pitches. In this case, the angles 66 formed between the sloped inner lateral walls 54 will be different on either side of the spaced transverse walls 58.

For example, while in the illustrated embodiment the vertex 64 is shown aligned along a central lateral axis, denoted B, it is contemplated that the vertex 64 may be shifted transversely from the lateral axis B. In this regard, variations in the angles 66 between the inner lateral walls 54 may be achieved. Additionally or alternatively, the vertical displacement of the vertex 64 with respect to the base 48 may be varied on either side of the spaced transverse walls 58 to thereby vary the angles 66 between the inner lateral walls 54.

Regardless of proportional variations, as shown in FIGS. 3 and 4, the conjunction of the laterally extending outlets 56 and the transverse outlet 60 forms an H-shaped airflow outlet 62. That is, when the nozzle 44 is orientated along the centrally disposed lateral axis B, the restricted upper airflow outlet 62 defines an H-shaped opening formed by the arrangement of the two laterally extending outlets 56 and the transverse outlet 60. As such, the nozzle extends vertically along the vertical axis A from a generally rectangular airflow inlet 49 to a generally H-shaped, restricted, airflow outlet 62 to create an airflow path therebetween.

In operation, the nozzle 44 receives airflow through the inlet 49 and directs the airflow to the restricted airflow outlet 62 to thereby expel the airflow away from the nozzle 44 at a high velocity. Specifically, air entering the nozzle 44 is initially confined by just the outer lateral walls 50 and the outer transverse walls 52 and, as it traverses up through the nozzle 44, the air meets and is directed by the inner lateral walls 54 from the vertex 64 to the laterally extending outlets 56. In this regard, the inner lateral walls 54 perform two operations. First, by creating the vertex 64, the arrangement efficiently cuts and separates the air flowing through the nozzle 44. Second, once separated, the airflow is accelerated away from vertical axis A and the central lateral axis B and directed towards the outer lateral periphery of the nozzle 44. This increases mixing of the exhaust air with the outside air through the space at the nozzle/windband interface. Accordingly, entrainment of air through the windband 42 above the nozzle 44 when installed in the exhaust fan assembly is increased. Therefore, the vertex 64 efficiently cuts and separates the airflow so that the angled inner lateral walls 54 can then force the airflow toward the outer lateral walls 50 and thereby accelerate the airflow toward and through the restricted airflow outlet 62.

Ambient air entrainment increases of 10-20% over conventional converging annular nozzles have been achieved empirically. This increased air entrainment provides for increased dilution of the building exhaust air before it is expelled from the exhaust system. It also increases the air flow mass exiting the exhaust system such that greater plume heights can be realized. Both of these features provide for better dispersion of the unwanted building exhaust air from the building surroundings.

Therefore, the above-described invention provides a cost-effective exhaust system nozzle that improves expulsion processes by accelerating air expelled from the nozzle while increasing entrainment of air from the windband. As a result, expulsion of undesirable air removed by an exhaust system is improved using a generally low cost, low maintenance H-shaped nozzle configuration.

The present invention has been described in terms of the preferred embodiment, and it should be appreciated that many equivalents, alternatives, variations, and modifications, aside from those expressly stated, are possible and within the scope of the invention. Therefore, the invention should not be limited to a particular described embodiment. To ascertain the full scope of the invention, the following claims should be referenced.

What is claimed is:

1. An exhaust assembly comprising:

a fan;

an exhaust nozzle for the fan including:

a pair of outer lateral walls and a pair of outer transverse walls extending from an inlet and forming an airflow path from the inlet to an outlet, the pair of outer lateral walls being spaced apart on opposite sides of a lateral axis extending in the direction between the pair of outer transverse walls;

a pair of sloped inner lateral walls that angle outwards in the direction from the inlet towards the corresponding one of the outer lateral walls to form a pair of laterally extending outlets at the outlet on each side of the lateral axis, wherein the sloped inner lateral walls partition the airflow passage into at least two distinct passages each extending to the corresponding outlet in an outward direction from the lateral axis toward the corresponding one of the outer lateral walls; and a pair of spaced transverse walls intersecting the sloped inner lateral walls and forming a transverse outlet joining the pair of laterally extending outlets; and a windband having an entry side disposed with respect to the nozzle so as to receive air from the outlet and to entrain air through a space between the nozzle and the windband, the windband narrowing from the entry side in a downstream direction;

wherein the walls of the nozzle are essentially planar and are joined at essentially perpendicular corners at the outlet of the nozzle such that the transverse outlet and the pair of laterally extending outlets form an H-shaped airflow outlet;

and wherein the nozzle directs exhaust air upwardly and outwardly to an outer periphery of the nozzle so that entrainment with ambient air introduced at the entry side of the windband is facilitated.

2. The exhaust assembly of claim 1 wherein the pair of sloped inner lateral walls extends from a vertex at the inlet.

3. The exhaust assembly of claim 2 wherein airflow entering the inlet is separated by the vertex and accelerated toward the pair of laterally extending outlets by the pair of sloped inner lateral walls.

4. The exhaust assembly of claim 2 wherein the vertex is aligned on the lateral axis.

5. The exhaust assembly of claim 1 wherein the pair of outer lateral walls and the pair of outer transverse walls form outer walls of the pair of laterally extending outlets and the pair of sloped inner lateral walls form inner walls of the pair of laterally extending outlets.

6. The exhaust assembly of claim 1 further comprising a rectangular base frame member disposed at the inlet and configured to engage the pair of outer lateral walls and the pair of outer transverse walls about a periphery of the rectangular base frame member.

7. The exhaust assembly of claim 1 wherein the exhaust assembly nozzle is configured to be arranged as a nozzle in an exhaust assembly of a building ventilation system.

8. An exhaust assembly for a ventilation system comprising:

a fan;

an exhaust nozzle for the fan including:

a base frame member arranged at an inlet;

a pair of outer lateral walls extending from opposing sides of the base frame member and disposed on opposite sides of a lateral axis;

a pair of outer transverse walls extending from opposing sides of the base frame member and disposed between the pair of opposing outer lateral walls;

a first set of inner lateral walls and a second set of inner lateral walls each extending from a vertex at the inlet toward the corresponding one of the pair of outer lateral walls and, with the pair of outer lateral walls and the pair of outer transverse walls, forming a pair of laterally extending outlets on each side of the lateral axis at an outlet of the nozzle; and a pair of spaced transverse walls separating the first set of inner lateral walls and the second set of inner lateral walls to form a transverse outlet at the outlet of the nozzle that joins the pair of laterally extending outlets; and a windband having an entry side disposed with respect to the nozzle so as to receive air from the outlet and to entrain air through a space between the nozzle and the windband, the windband narrowing from the entry side in a downstream direction;

wherein the inner lateral walls divide airflow from the inlet into at least two distinct passages extending to the corresponding outlet in an outward direction from the lateral axis toward the corresponding one of the outer lateral walls and wherein the walls of the nozzle are essentially planar and are joined at essentially perpendicular corners at the outlet of the nozzle such that the transverse outlet and the pair of laterally extending outlets form an H-shaped airflow outlet;

and wherein the nozzle directs exhaust air upwardly and outwardly to an outer periphery of the nozzle so that entrainment with ambient air introduced at the entry side of the windband is facilitated.

9. The exhaust assembly of claim 8 wherein the first set of inner lateral walls extend away from the vertex to form a first acute angle therebetween and the second set of inner lateral walls extend away from the vertex to form a second acute angle therebetween.

10. The exhaust assembly of claim 9 wherein the first acute angle and the second acute angle are essentially the same.

11. The exhaust assembly of claim 8 wherein the vertex is aligned along the lateral axis.

12. The exhaust assembly of claim 8 wherein the first set of inner lateral walls and the second set of inner lateral walls angle outwards to form respective acute angles therebetween.

13. An exhaust system comprising:

a fan;

a ventilation system nozzle for the fan including:

a pair of outer lateral walls spaced apart on opposite sides of a lateral axis; a pair of outer transverse walls arranged between the pair of outer lateral walls to form a generally rectangular nozzle inlet;

a first pair of inner lateral walls and a second pair of inner lateral walls each angled from the lateral axis toward the corresponding one of the outer lateral walls to form a pair of laterally extending outlets on each side of the lateral axis, wherein the inner lateral walls divide airflow from the inlet into at least two distinct passages extending to the corresponding outlet in an outward direction from the lateral axis toward the corresponding one of the outer lateral walls; and a pair of spaced transverse walls disposed between the first pair of inner lateral walls and the second pair of inner lateral walls to form a transverse outlet joining the pair of laterally extending outlets, the transverse outlet and the pair of laterally extending outlets forming an H-shaped outlet, the walls of the nozzle being essentially planar and joined at essentially perpendicular corners at the H-shaped air flow outlet; and a windband having an entry side disposed with respect to the nozzle so as to receive air from the H-shaped outlet and to entrain air through a space between the nozzle and the windband, the windband narrowing from the entry side in a downstream direction;

and wherein the nozzle directs exhaust air upwardly and outwardly to an outer periphery of the nozzle so that entrainment with ambient air introduced at the entry side of the windband is facilitated.

14. The exhaust system of claim 13 wherein the pair of spaced transverse walls is displaced from the pair of outer transverse walls and extends generally parallel to a vertical axis.

15. The exhaust system of claim 14 wherein the first pair of inner lateral walls and the second pair of inner lateral walls extend from the lateral axis away from the vertical axis.

16. The exhaust system of claim 15 wherein the first pair of inner lateral walls extend away from a vertex to form a first acute angle therebetween and the second pair of inner lateral walls extend away from the vertex to form a second acute angle therebetween.

* * * * *